US008349532B2

(12) United States Patent
Kusaka et al.

(10) Patent No.: US 8,349,532 B2
(45) Date of Patent: Jan. 8, 2013

(54) TONER FOR ELECTROSTATIC CHARGE IMAGE DEVELOPMENT AND METHOD FOR PRODUCING THE SAME

(75) Inventors: Natsuko Kusaka, Tokyo (JP); Naohiro Hirose, Tokyo (JP); Tatsuya Nagase, Tokyo (JP); Hiroyuki Yasukawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 13/363,843

(22) Filed: Feb. 1, 2012

(65) Prior Publication Data

US 2012/0135343 A1 May 31, 2012

Related U.S. Application Data

(62) Division of application No. 12/410,608, filed on Mar. 25, 2009, now abandoned.

(30) Foreign Application Priority Data

Apr. 15, 2008 (JP) ..... 2008-105584

(51) Int. Cl.
*G03G 9/08* (2006.01)

(52) U.S. Cl. ..... 430/137.21; 430/137.1

(58) Field of Classification Search ..... 430/137.1, 430/137.21
See application file for complete search history.

(56) References Cited

U.S. PATENT DOCUMENTS 4,734,350 A 3/1988 Lin et al.

FOREIGN PATENT DOCUMENTS

| | | |
|---|---|---|
| JP | 11335339 | 12/1992 |
| JP | 5297633 | 11/1993 |
| JP | 649008 | 2/1994 |
| JP | 10226673 | 8/1998 |
| JP | 2005298458 | 10/2005 |
| JP | 2005533764 | 11/2005 |

*Primary Examiner* — Hoa V Le
(74) *Attorney, Agent, or Firm* — Lucas & Mercanti, LLP

(57) ABSTRACT

Provided is a toner for an electrostatic charge image development having toner particles which contain: a binder resin; a colorant; and a compound represented by Formula (1) in an amount of 0.1 to 65 ppm based on the total weight of the toner particles:

Formula (1)

wherein $R^1$ and $R^2$ each respectively represents a hydrogen atom, an alkyl group having 1 to 4 carbon atoms, or an aryl group.

4 Claims, 2 Drawing Sheets

TONER FOR ELECTROSTATIC CHARGE IMAGE DEVELOPMENT AND METHOD FOR PRODUCING THE SAME

CROSS REFERENCE TO RELATED APPLICATIONS

This application is a Divisional application of U.S. application Ser. No. 12/410,608 filed Mar. 25, 2009, which was based on Japanese Patent Application No. 2008-105584 filed on Apr. 15, 2008 with Japan Patent Office, the entire content of which is hereby incorporated by reference.

TECHNICAL FIELD

The present invention relates to a toner for an electrostatic charge image development (hereinafter, it is also referred to as an electrostatic image developing toner, or simply, a toner) employed for electrophotographic image formation, and a method for producing the same.

BACKGROUND

In recent years, by using an image formation method of an electrophotography system employing an electrostatic image developing toner, formation of a full color image (a full color print) has been performed in addition to formation of a monochrome image (a monochrome print) which has been used mainly for creation of a document etc.

In the image formation method of the electrophotography system employing such a toner for electrostatic image development, color toner particles are used to form a color image. Examples of the color toner particles are a yellow toner particle, a magenta toner particle and a cyan toner particle, each of these color toner particles containing a binder resin and colorant for each color. By superposing the toner images formed by each of these color toner particles, a color tone is adjusted and, thereby, a full color image is formed.

In order to form a full color image especially used for a catalog, an advertisement, and the like, it is required that an original image should be reproduced faithfully. As a consequence, a good color reproduction property is required for color toner particles in order to form a full color image having a desired color tone.

Application of various organic pigments and dyes to a colorant for a color toner particle has been examined. Examples of colorants used for a magenta toner particle are: an azo lake pigment, an anthraquinone dye, a quinacridone pigment, a rhodamine dye and its lake pigment (for example, refer to patent documents 1-6.)

However, there are several problems to use toner particles containing these colorants. Specifically, it is hard to obtain an intermediate color (half-tone) image having a high enough quality especially by using a color toner particle incorporating a low molecular weight dye such as a rhodamine dye (a rhodamine dye compound). Further, when the color toner particle is kept for a long time at an ordinary temperature, the toner particle tends to be aggregated to become a granular particle and to result in failing to obtain sufficient fixability of an image.

In the color toner particle which incorporates a dye of low molecular weight as a colorant, the causes which produce the above-mentioned problem are thought to be as follows. One of the causes may be a decrease of a glass transition temperature of the color toner particle incorporating the dye of low molecular weight due to that fact that this dye has a high compatibility with a resin. Another cause may be a decrease of thermal energy which should be used for fixing of the toner, because this dye may be sublimated during the thermal fixing of the image. This means that a part of thermal energy will be consumed by sublimation of this dye and sufficient thermal energy is not provided for fixing.

Patent Document 1: Unexamined published Japanese patent application (hereafter it is called as JP-A) No. 5-297633

Patent Document 2: JP-A No. 2005-298458

Patent Document 3: JP-A No. 10-226673

Patent Document 4: JP-A No. 11-335339

Patent Document 5: JP-A No. 6-49008

Patent Document 6: Japanese translation of PCT international application No. 2005-533764

SUMMARY

The present invention was achieved in view of the aforementioned situations. An object of the present is to provide a toner for an electrostatic charge image development having high storage stability, as well as a superior transferring property and a superior fixing property, resulting in producing an image of high image quality. Another object is to provide a method to produce such toner.

A toner for an electrostatic charge image development of the present invention comprises:

toner particles containing a binder resin and a colorant; and a compound represented by Formula (1) in an amount of 0.1 to 65 ppm based on the total weight of the toner particles:

Formula (1)

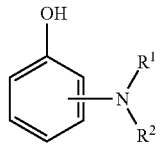

In Formula (1), $R^1$ and $R^2$ each respectively represents a hydrogen atom, an alkyl group having 1 to 4 carbon atoms, or an aryl group. The substituent $—N(R^1)R^2$ is located at any one position of an ortho, meta or para position with respect to the carbon atom of a phenyl ring bonded to a hydroxyl group.

In the toner for an electrostatic charge image development of the present invention, the compound represented by Formula (1) is preferably an ortho substituted compound represented by Formula (1A) or a meta substituted compound represented by Formula (1B):

Formula (1A)

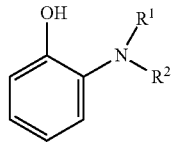

Formula (1B)

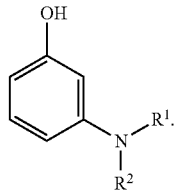

An especially preferred compound represented by Formula (1) is a meta substituted compound having an alkyl group of 1 to 4 carbon atoms for both $R^1$ and $R^2$ in Formula (1). Here, an ortho substituted compound indicates a compound having a substituent at an ortho position with respect to the carbon atom of the phenyl ring to which a hydroxyl group is bonded. A meta substituted compound indicates a compound having a substituent at an meta position with respect to the carbon atom of the phenyl ring to which a hydroxyl group is bonded.

In the toner for an electrostatic charge image development of the present invention, the colorant is preferably composed of a dye.

A method for producing the toner for an electrostatic charge image development of the present invention comprises the step of mixing a colored composition composed of a colorant and a compound represented by Formula (1) in an amount of 1 to 650 ppm based on the total weight of the colored composition and (ii) with a binder resin, so as to obtain the toner particle containing the compound represented by Formula (1) in an amount of 0.1 to 65 ppm based on the total weight of the toner particle.

The toner for an electrostatic charge image development of the present invention can provide an intermediate color (halftone) image of high quality to result in forming high transfer property. This high transfer property is achieved by incorporation of a specific compound in a specific amount into the toner particles, which results in stabilization of an anion charge on the toner particles composed of the toner. The hydrogen bonding existing in the binder resin tends to be decreased by the presence of the specific compound. This leads to high storage stability of the toner and high fixing property of the toner.

Consequently, by employing the electrostatic image developing toner of the present invention, superior transfer property and fixing property can be achieved with having high storage stability. As a result, an image of high quality can be formed. Further, by employing the method for producing the electrostatic charge developing toner of the present invention, superior transfer property and fixing property can be obtained with having high storage stability. As a result, the toner which forms an image of high quality can be obtained.

DESCRIPTION OF THE PREFERRED EMBODIMENTS

Figure 1:
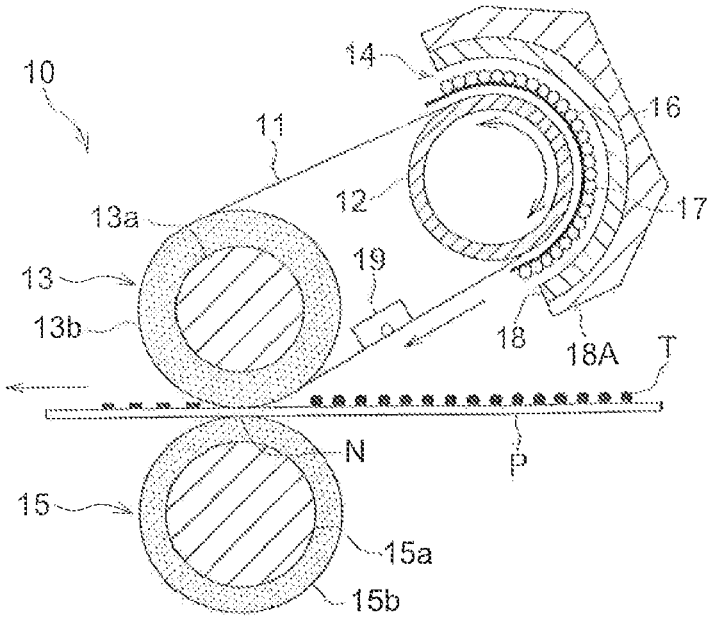
FIG. 1 is a cross-sectional view showing one example of the constitution of a fixing apparatus employed for image formation employing the electrostatic image developing toner of the present invention.

The toner for an electrostatic charge image development of the present invention is composed of particles (toner particles) which contain at least a binder resin and a colorant. The electrostatic image developing toner of the present invention is characterized in that a compound represented by Formula (1) (hereafter it is called also as "a specific aminophenol compound) is contained in the toner particles in an amount of 0.1 to 65 ppm.

The toner particles of the present invention should just contain a binder resin, a colorant and a specific aminophenol compound. The toner particles of the present invention may contain other element such as a mold releasing agent (wax) as a constituting component of the toner particles.

In Formula (1) associated with a specific aminophenol compound, $R^1$ and $R^2$ each respectively represents a hydrogen atom, an alkyl group having 1 to 4 carbon atoms, or an aryl group.

An alkyl group represented by $R^1$ and $R^2$ is one of a methyl group, an ethyl group, a propyl group and a butyl group.

Examples of an aryl group represented by $R^1$ and $R^2$ include: a phenyl group, a benzyl group, a tolyl group and o-xylyl group.

$R^1$ and $R^2$ each are preferably a hydrogen atom or an alkyl group having 1 to 4 carbon atoms, more preferably an alkyl group having 2 carbon atoms (i.e., an ethyl group).

In Formula (1), an amino group having $R^1$ and $R^2$ (hereafter it is called as "a specific amino group") may be located at an ortho position, a meta position or a para position with respect to the carbon atom of the phenyl group to which a hydroxyl group is bonded. From the viewpoint of preventing the generation of dust during the transfer step of the image, the amino group is preferably located at an ortho position or a meta position. More preferably, the amino group is preferably located at a meta position.

Specific examples represented by Formula (1) include the following compounds (1) to (75).

Among these examples, Compound (13) in which both $R^1$ and $R^2$ are an ethyl group can be cited as a most preferable compound in the group of compounds having a specific amino group at an ortho position.

And further, Compound (38) in which both $R^1$ and $R^2$ are an ethyl group can be cited as a most preferable compound in the group of compounds having a specific amino group at a meta position.

(Examples of Compounds Represented by Formula (1))

Compound (1): Compound having a specific amino group at an ortho position, provided that both $R^1$ and $R^2$ are a hydrogen atom.

Compound (2): Compound having a specific amino group at an ortho position, provided that $R^1$ is a hydrogen atom and $R^2$ is a methyl group.

Compound (3): Compound having a specific amino group at an ortho position, provided that $R^1$ is a hydrogen atom and $R^2$ is an ethyl group.

Compound (4): Compound having a specific amino group at an ortho position, provided that $R^1$ is a hydrogen atom and $R^2$ is a propyl group.

Compound (5): Compound having a specific amino group at an ortho position, provided that $R^1$ is a hydrogen atom and $R^2$ is a butyl group.

Compound (6): Compound having a specific amino group at an ortho position, provided that $R^1$ is a methyl group and $R^2$ is a hydrogen atom.

Compound (7): Compound having a specific amino group at an ortho position, provided that both $R^1$ and $R^2$ are a methyl group.

Compound (8): Compound having a specific amino group at an ortho position, provided that $R^1$ is a methyl group and $R^2$ is an ethyl group.

Compound (9): Compound having a specific amino group at an ortho position, provided that $R^1$ is a methyl group and $R^2$ is a propyl group.

Compound (10): Compound having a specific amino group at an ortho position, provided that $R^1$ is a methyl group and $R^2$ is a butyl group.

Compound (11): Compound having a specific amino group at an ortho position, provided that $R^1$ is an ethyl group and $R^2$ is a hydrogen atom.

Compound (12): Compound having a specific amino group at an ortho position, provided that $R^1$ is an ethyl group and $R^2$ is a methyl group.

Compound (13): Compound having a specific amino group at an ortho position, provided that both $R^1$ and $R^2$ are an ethyl group.

Compound (14): Compound having a specific amino group at an ortho position, provided that $R^1$ is an ethyl group and $R^2$ is a propyl group.

Compound (15): Compound having a specific amino group at an ortho position, provided that $R^1$ is an ethyl group and $R^2$ is a butyl group.

Compound (16): Compound having a specific amino group at an ortho position, provided that $R^1$ is a propyl group and $R^2$ is a hydrogen atom.

Compound (17): Compound having a specific amino group at an ortho position, provided that $R^1$ is a propyl group and $R^2$ is a methyl group.

Compound (18): Compound having a specific amino group at an ortho position, provided that $R^1$ is a propyl group and $R^2$ is an ethyl group.

Compound (19): Compound having a specific amino group at an ortho position, provided that both $R^1$ and $R^2$ are a propyl group.

Compound (20): Compound having a specific amino group at an ortho position, provided that $R^1$ is a propyl group and $R^2$ is a butyl group.

Compound (21): Compound having a specific amino group at an ortho position, provided that $R^1$ is a butyl group and $R^2$ is a hydrogen atom.

Compound (22): Compound having a specific amino group at an ortho position, provided that $R^1$ is a butyl group and $R^2$ is a methyl group.

Compound (23): Compound having a specific amino group at an ortho position, provided that $R^1$ is a butyl group and $R^2$ is an ethyl group.

Compound (24): Compound having a specific amino group at an ortho position, provided that $R^1$ is a butyl group and $R^2$ is a propyl group.

Compound (25): Compound having a specific amino group at an ortho position, provided that both $R^1$ and $R^2$ are a butyl group.

Compound (26): Compound having a specific amino group at a meta position, provided that both $R^1$ and $R^2$ are a hydrogen atom.

Compound (27): Compound having a specific amino group at a meta position, provided that $R^1$ is a hydrogen atom and $R^2$ is a methyl group.

Compound (28): Compound having a specific amino group at a meta position, provided that $R^1$ is a hydrogen atom and $R^2$ is an ethyl group.

Compound (29): Compound having a specific amino group at a meta position, provided that $R^1$ is a hydrogen atom and $R^2$ is a propyl group.

Compound (30): Compound having a specific amino group at a meta position, provided that $R^1$ is a hydrogen atom and $R^2$ is a butyl group.

Compound (31): Compound having a specific amino group at a meta position, provided that $R^1$ is a methyl group and $R^2$ is a hydrogen atom.

Compound (32): Compound having a specific amino group at a meta position, provided that both $R^1$ and $R^2$ are a methyl group.

Compound (33): Compound having a specific amino group at a meta position, provided that $R^1$ is a methyl group and $R^2$ is an ethyl group.

Compound (34): Compound having a specific amino group at a meta position, provided that $R^1$ is a methyl group and $R^2$ is a propyl group.

Compound (35): Compound having a specific amino group at a meta position, provided that $R^1$ is a methyl group and $R^2$ is a butyl group.

Compound (36): Compound having a specific amino group at a meta position, provided that $R^1$ is an ethyl group and $R^2$ is a hydrogen atom.

Compound (37): Compound having a specific amino group at a meta position, provided that $R^1$ is an ethyl group and $R^2$ is a methyl group.

Compound (38): Compound having a specific amino group at a meta position, provided that both $R^1$ and $R^2$ are an ethyl group.

Compound (39): Compound having a specific amino group at a meta position, provided that $R^1$ is an ethyl group and $R^2$ is a propyl group.

Compound (40): Compound having a specific amino group at a meta position, provided that $R^1$ is an ethyl group and $R^2$ is a butyl group.

Compound (41): Compound having a specific amino group at a meta position, provided that $R^1$ is a propyl group and $R^2$ is a hydrogen atom.

Compound (42): Compound having a specific amino group at a meta position, provided that $R^1$ is a propyl group and $R^2$ is a methyl group.

Compound (43): Compound having a specific amino group at a meta position, provided that $R^1$ is a propyl group and $R^2$ is an ethyl group.

Compound (44): Compound having a specific amino group at a meta position, provided that both $R^1$ and $R^2$ are a propyl group.

Compound (45): Compound having a specific amino group at a meta position, provided that $R^1$ is a propyl group and $R^2$ is a butyl group.

Compound (46): Compound having a specific amino group at a meta position, provided that $R^1$ is a butyl group and $R^2$ is a hydrogen atom.

Compound (47): Compound having a specific amino group at a meta position, provided that $R^1$ is a butyl group and $R^2$ is a methyl group.

Compound (48): Compound having a specific amino group at a meta position, provided that $R^1$ is a butyl group and $R^2$ is an ethyl group.

Compound (49): Compound having a specific amino group at a meta position, provided that $R^1$ is a butyl group and $R^2$ is a propyl group.

Compound (50): Compound having a specific amino group at a meta position, provided that both $R^1$ and $R^2$ are a butyl group.

Compound (51): Compound having a specific amino group at a para position, provided that both $R^1$ and $R^2$ are a hydrogen atom.

Compound (52): Compound having a specific amino group at a para position, provided that $R^1$ is a hydrogen atom and $R^2$ is a methyl group.

Compound (53): Compound having a specific amino group at a para position, provided that $R^1$ is a hydrogen atom and $R^2$ is an ethyl group.

Compound (54): Compound having a specific amino group at a para position, provided that $R^1$ is a hydrogen atom and $R^2$ is a propyl group.

Compound (55): Compound having a specific amino group at a para position, provided that $R^1$ is a hydrogen atom and $R^2$ is a butyl group.

Compound (56): Compound having a specific amino group at a para position, provided that $R^1$ is a methyl group and $R^2$ is a hydrogen atom.

Compound (57): Compound having a specific amino group at a para position, provided that both $R^1$ and $R^2$ are a methyl group.

Compound (58): Compound having a specific amino group at a para position, provided that $R^1$ is a methyl group and $R^2$ is an ethyl group.

Compound (59): Compound having a specific amino group at a para position, provided that $R^1$ is a methyl group and $R^2$ is a propyl group.

Compound (60): Compound having a specific amino group at a para position, provided that $R^1$ is a methyl group and $R^2$ is a butyl group.

Compound (61): Compound having a specific amino group at a para position, provided that $R^1$ is an ethyl group and $R^2$ is a hydrogen atom.

Compound (62): Compound having a specific amino group at a para position, provided that $R^1$ is an ethyl group and $R^2$ is a methyl group.

Compound (63): Compound having a specific amino group at a para position, provided that both $R^1$ and $R^2$ are an ethyl group.

Compound (64): Compound having a specific amino group at a para position, provided that $R^1$ is an ethyl group and $R^2$ is a propyl group.

Compound (65): Compound having a specific amino group at a para position, provided that $R^1$ is an ethyl group and $R^2$ is a butyl group.

Compound (66): Compound having a specific amino group at a para position, provided that $R^1$ is a propyl group and $R^2$ is a hydrogen atom.

Compound (67): Compound having a specific amino group at a para position, provided that $R^1$ is a propyl group and $R^2$ is a methyl group.

Compound (68): Compound having a specific amino group at a para position, provided that $R^1$ is a propyl group and $R^2$ is an ethyl group.

Compound (69): Compound having a specific amino group at a para position, provided that both $R^1$ and $R^2$ are a propyl group.

Compound (70): Compound having a specific amino group at a para position, provided that $R^1$ is a propyl group and $R^2$ is a butyl group.

Compound (71): Compound having a specific amino group at a para position, provided that $R^1$ is a butyl group and $R^2$ is a hydrogen atom.

Compound (72): Compound having a specific amino group at a para position, provided that $R^1$ is a butyl group and $R^2$ is a methyl group.

Compound (73): Compound having a specific amino group at a para position, provided that $R^1$ is a butyl group and $R^2$ is an ethyl group.

Compound (74): Compound having a specific amino group at a para position, provided that $R^1$ is a butyl group and $R^2$ is a propyl group.

Compound (75): Compound having a specific amino group at a para position, provided that both $R^1$ and $R^2$ are a butyl group.

In the toner for an electrostatic charge image development of the present invention, the specific aminophenol compound contained in the toner particles may be used singly or may be used in combination with two or more kinds of specific aminophenol compounds as described above.

An amount of the specific aminophenol compound contained in the toner particles is preferably 0.1 to 65 ppm based on the total weight of the toner particles. From the viewpoints of compatibility of both transferring property and storage stability of the toner particles, an amount of the specific aminophenol compound is more preferably from 0.4 to 14 ppm.

When the amount of the specific aminophenol compound is less than 0.1 ppm, it is difficult to achieve high storage stability, high transferring property and high fixing property at the same time. As a result, it is hard to form an image of high quality.

On the other hand, when the amount of the specific aminophenol compound is more than 65 ppm, a ratio of the toner particles having an inverse polarity tends to be higher. This may cause harmful effects such as scattering of the toner particles.

An amount of the specific aminophenol compound contained in the toner particles can be determined with a method such as a combination of liquid chromatography/mass spectrography (LC/MS).

(Binder Resin)

A binder resin constituting the toner particles of the present invention is not specifically limited. A variety of polymers obtained by polymerization of a polymerizable monomer can be used for the binder resin in the present invention.

The polymer used for the binder resin in the present invention comprises a polymer produced by at least one kind of polymerizable monomer. The polymer may be produced from one kind of polymerizable monomer or may be produced in combination with a plurality of polymerizable monomers.

Specific examples of polymers used for the binder resin, as most representative examples, include: vinyl polymers produced from vinyl monomers; and polyester resins produced from an acid anhydride or a polyvalent carboxylic acid and a polyvalent alcohol.

Examples of a vinyl monomer to form a vinyl polymer include: styrenes, for example, styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, a p-n-nonylstyrene, p-n-decylstyrene, and p-n-dodecyl styrene, and derivatives thereof; methacrylate derivatives, for example, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate; acrylate derivatives, for example, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate; olefins, for example, ethylene, propylene, and isobutylene; vinyl esters, for example, vinyl propionate, vinyl acetate and vinyl benzoate; vinyl ethers, for example, vinyl methyl ether and vinyl ethyl ether; and acrylic acid or methacrylic acid derivatives, for example, acrylonitrile, methacrylonitrile and acrylamide. These vinyl monomers may be used alone or may be used in combination.

Resins usable in the invention include a polyester resin obtained by polycondensation of an acid anhydride or a polyvalent carboxylic acid having at least two carboxyl groups and a polyvalent alcohol having at least two hydroxyl groups. Specific examples of a polyvalent carboxylic acid include aliphatic dicarboxylic acids such as citric acid, malonic acid, maleic acid, fumaric acid, citraconic acid, itaconic acid, glucuronic acid, succinic acid, adipic acid, sebacic acid, n-dodecylsuccinic acid, n-dodecylsuccinic acid and n-dodecenylsuccinic acid; alicyclic dicarboxylic acids such as hexanedicarboxylic acid and aromatic dicarboxylic acids such as phthalic acid, isophthalic acid and terephthalic acid. Specific examples of a polyvalent alcohol include aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; aromatic diols such as an alkylene oxide adduct of bisphenol A; and polyols such as glycerin, pentaerythritol, trimethylolpropane, and sorbitol. These polyvalent alcohols may be combined.

Moreover, it is still more preferable to use a polymerizable monomer having an ionically dissociable group as a functional group in the side chain, such as a carboxyl group, a sulfonic acid group, and a phosphoric acid group, in combination with a vinyl monomer so as to obtain a vinyl polymer. Specific examples of a polymerizable monomer containing an ionically dissociable group are as follows. Examples of a monomer having a carboxyl group include: acrylic acid, methacrylic acid, maleic acid monoalkyl ester, itaconic acid, cinnamic acid, fumaric acid, maleic acid mono-alkyl ester, and itaconic acid mono-alkyl ester. Examples of a monomer having a sulfonic acid group include: styrene sulfonic acid, allylsulfosuccinic acid, and 2-acrylamide-2-methylpropanesulfonic acid. Examples of a monomer having Monomers having a phosphoric acid group include: acid phosphoxyethyl methacrylate.

Further, polyfunctional vinyl compounds may be used to form a resin having a cross-linking structure. Examples of a polyfunctional vinyl compound include: divinylbenezne, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate.

A colorant constituting the toner particles of the present invention is not specifically limited. Although publicly known dyes and organic pigments can be used for the present invention, but dyes are preferably used for the present invention.

Specific examples of dyes preferably used for the purpose of achieving appropriate half-tone reproduction are shown below.

Examples of a black colorant include: C. I. Solvent Black 3, C. I. Solvent Black 5, C. I. Solvent Black 22, and C. I. Solvent Black 23.

Examples of a magenta colorant and a cyan colorant include compounds represented by Formula (A) or Formula (B).

Formula (A)

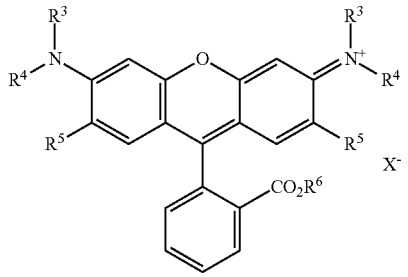

In Formula (A), $R^3$ and $R^4$ each respectively represents a hydrogen atom, an alkyl group having 1 to 4 carbon atoms; $R^6$ represents a hydrogen atom, an alkyl group having 1 to 8 carbon atoms or an alkoxyl group having 1 to 4 carbon atoms; $R^6$ represents an alkyl group having 1 to 8 carbon atoms or an aralkyl group; and X represents a halogen atom or a silicomolybdic acid.

Formula (B)

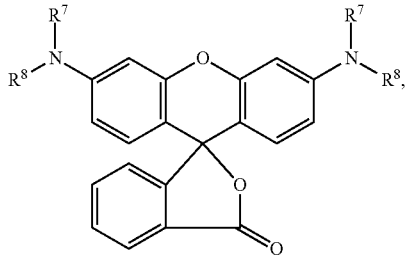

In Formula (B), $R^7$ and $R^8$ each respectively represents a hydrogen atom, an alkyl group having 1 to 4 carbon atoms, an aryl group having 6 to 10 carbon atoms or a cycloalkyl group having 6 to 8 carbon atoms.

Here, specific examples of compounds represented by Formula (A) are compounds (A-1), (A-2) and (A-3) shown below.

(A-1): Compound represented by Formula (A) in which $R^3$ is a hydrogen atom, $R^4$ is an ethyl group, $R^5$ is a methyl group, $R^6$ is an ethyl group and X is a chlorine atom.

(A-2): Compound represented by Formula (A) in which $R^3$ is an ethyl group, $R^4$ is an ethyl group, $R^5$ is a hydrogen atom, $R^6$ is an ethyl group and X is a chlorine atom.

(A-3): Compound represented by Formula (A) in which $R^3$ is an ethyl group, $R^4$ is an ethyl group, $R^5$ is a methoxy group, $R^6$ is an ethyl group and X is a chlorine atom.

Further, specific examples of compounds represented by Formula (B) are compounds (B-1), (B-2) and (B-3) shown below.

(B-1): Compound represented by Formula (B) in which $R^7$ is a hydrogen atom and $R^8$ is an ethyl group.

(B-2): Compound represented by Formula (B) in which both $R^7$ and $R^8$ are an ethyl group.

(B-3): Compound represented by Formula (B) in which both $R^7$ and $R^8$ are a phenyl group.

Examples of an orange colorant or a yellow colorant include: C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 112, and C. I. Solvent Yellow 162.

Examples of a green colorant or a cyan colorant include: C. I. Solvent Blue 22, C. I. Solvent Blue 63, C. I. Solvent Blue 67, C. I. Solvent Blue 78, C. I. Solvent Blue 83, C. I. Solvent Blue 84, C. I. Solvent Blue 85, C. I. Solvent Blue 86, C. I. Solvent Blue 104, C. I. Solvent Blue 191, C. I. Solvent Blue 194, C. I. Solvent Blue 195, C. I. C. I. Solvent Green 24, C. I. Solvent Green 25.

A molecular weight of the colorant used in the present invention is preferably from 275 to 1650, and more preferably from 400 to 550.

In the present invention, colorants subjected to surface modification can be used. Publicly known surface modification agents can be used for that purpose. Specific examples of a surface modification agent preferably used in the present invention include: a silane coupling agent, a titan coupling agent and an aluminium coupling agent.

The aforementioned colorant can be used singly or in combination with two or more kinds of colorants.

An amount of a colorant added in the toner particles of the present invention is preferably in the range of 1 to 30 weight %, and more preferably in the range of 2 to 20 weight % based on the total weight of the toner particles.

The toner particles of the present invention may include other constituting components such as a mold releasing agent and others in addition to a binder resin, a colorant and a specific aminophenol compound.

(Mold Releasing Agents)

Examples of mold releasing agents include polyolefin waxes such as polyethylene wax and polypropylene wax; long hydrocarbon chain based waxes such as paraffin wax and Sasol wax; dialkyl ketone based waxes such as distearyl ketone; ester based waxes such as carnauba wax, montan wax, trimethylolpropane tribehenate, pentaerythritol tetrabehenate, pentaerythritol tetrastearate, pentaerythritol diacetate dibehenate, glycerin tribehenate, 1,18-octadecanediol distearate, tristearyl trimellitate, and distearyl maleate; and amido based waxes such as trimellitic acid tristearylamide.

The wax used as a constituting material for the toner particles of the present invention has usually a melting point of from 40 to 125° C., preferably from 50 to 120° C., and more preferably from 60 to 120° C.

By using a wax having a melting point within the range as mentioned above, thermal storage stability of the toner particles of the present invention can be achieved, and at the same time, stable image formation can be achieved without causing a failure such as cold off-set even when a low temperature fixing is applied.

The amount of a wax incorporated in the toner particles of the present invention is preferably 1 to 30% by weight with respect to the total weight of the toner particles, and is more preferably 5 to 20% by weight.

The toner particles in the toner of the present invention preferably have a volume based median diameter ($D50_v$) from 3 to 8 μm. By controlling the volume based median diameter of the toner particles within the range as mentioned above, faithful reproduction of the image composed of very minute dots, such as 12000 dpi (the number of dots within one inch, 2.54 cm), can be realized. As a result, when the toner is applied to produce a photographic image, an image having the same or higher definition as an image produced by printing inks can be formed. Consequently, when the toner is applied to produce a photographic image as a visible image, a photographic image with high color reproduction can be obtained. The toner of the present invention can be easily used for producing several hundreds to several thousands printings of full-color images including high definition photographic images in a small volume printing field.

The volume based median diameter ($D50_v$) of the toner particles of the present invention can be measured and determined employing a size distribution measurement instrument, "COULTER MULTISIZER 3" (produced by Beckman-Coulter Co.) connected with a computer system (produced by Beckman-Coulter Co.) for data processing.

Measurement procedures are as follows. After allowing to soak 0.02 g of toner with 20 ml of a surface active agent solution (for example, a surface active agent solution, aimed at dispersing the toner), which is prepared by diluting a neutral detergent incorporating surface active agent components by a factor of 10), the mixture is subjected to microwave dispersion for one minute, whereby a toner dispersion is prepared. The resulting toner dispersion is injected into a beaker carrying ISOTON II (produced by Beckman-Coulter Co.) in the sample stand until reaching a measurement concentration of 8% by weight. By controlling the concentration to this range, a high reproducible measurement value can be obtained. And measurement is carried out while setting the count of the instrument at 2,500 and the employed aperture diameter of 50 μm. The measuring range of 1 to 30 μm is divided into 256 sections and a frequency value in each section is calculated. The volume based median diameter ($D50_v$) is a particle diameter at which 50% of a volume ratio is achieved when each volume is integrated from a large sized particle to a small sized particle.

The toner particles in the electrostatic image developing toner of the present invention preferably have a coefficient of variation (CV value) of a volume based particle diameter distribution in the range of 2 to 21%, and more preferably from 5 to 15%.

A coefficient of variation (CV value) of a volume based particle diameter distribution indicates a degree of distribution of a volume based toner particles size and calculated by the following Equation (1). When the CV value is small, it means that the particle diameter distribution is narrow, hence, the size of the toner particles is uniform.

*CV* value (%)=((standard deviation in the volume based particle distribution)/(median diameter ($D50_v$) in the volume based particle distribution))×100. Equation (1):

By controlling the CV value within the range as described above, the toner particles become uniform in volume size, which makes it possible to reproduce a fine dot or fine line with high precision required for forming a digital image. When the toner is applied to produce a photographic image, an image having the same or higher definition as an image produced by printing inks can be formed.

The electrostatic image developing toner of the present invention contains preferably toner particles having an average circularity defined by the following Equation (2) of 0.930 to 1.000, and more preferably, of 0.950 to 0.995 from the viewpoint of increasing transferring efficiency.

Average circularity=(circumferential length of a circle having the same projective area as that of a particle image)/(circumferential length of the projective particle image) Equation (2)

The measuring method to determine the average circularity is not specifically limited. One of the examples is as follows: to take a photograph of toner particles at a 500-fold magnification with an electron microscope; then a circularity of each of the 500 or more toner particles observed in the taken photograph is measured and a mathematic average of circularity is determined to obtain an average circularity. An example of simple and easy measurement methods is to use "FPIA-2100" (produced by Sysmex Co.).

The toner particles in the electrostatic image developing toner of the present invention have preferably a softening point ($T_{sp}$) of from 70 to 120° C., and more preferably from 70 to 110° C.

By setting the softening point to be within the above-described range, sublimation or pyrolysis which may be induced by the heat applied during fixing can be decreased. As a consequence, an image can be formed without imposing undue thermal stress to the colorant. Thus obtained observable image will be provided with a wide and stable color reproduction property.

Further, due to the fact that there is practically no energy consumption for evaporation of water contained in a transfer paper (an image support), and the applied energy is expected to be used mainly for fixing of an image, image formation which realizes a decreased electric power consumption and reduced environmental load can be achieved.

The control of a softening point of the electrostatic image developing toner of the present invention can be done, for example, by the following ways: (1) to control the kinds or the composition rates of the polymerizable monomers to produce a resin; (2) to employ a chain transfer agent to produce a resin in the course of production step of the electrostatic image developing toner, and to control the kinds and the amount of the chain transfer agent so as to adjust the molecular weight of the polymer; and (3) to control the kinds and the amount of the constituting material such as a molding releasing agent.

The softening point of the toner particles in the electrostatic image developing toner of the present invention can be measured, for example, with "Flow Tester CFT-500" (produced by Shimadzu Corporation) as follows: to form a cylindrical column having a height of 10 mm using with toner particles; then to apply a pressure of $1.96\times10^6$ Pa to the cylindrical column made of the toner particles with a plunger while heating the cylindrical column at a rate of temperature increase of 6° C./minute so as to extrude the toner particles from a nozzle having a diameter of 1 mm and a height of 1 mm; to obtain a softening flow curve which indicates the relationship between the temperature and the amount of falling from the plunger; and to determine a softening temperature as a temperature at which an amount of falling from the plunger is 5 mm.

The electrostatic image developing toner of the present invention can be produced using publicly known methods. An example of the producing method is a pulverization method which contains the steps of: a mixing step (when required further contains a pre-mixing step in advance); a kneading step; a pulverizing step; and a classifying step in the sequence set forth above. Another example is a polymerization method, (more specifically, an emulsion polymerization method, a suspension polymerization method and a polyester elongation method).

When the electrostatic image developing toner of the present invention is produced by a pulverization method, the heating temperature at a kneading step is preferably 130° C. or less. The reason to control the heating temperature to be 130° C. or less, that is to keep the temperature of the kneaded composition to be 130° C. or less, is considered as follows. When the temperature of the kneaded composition exceeds 130° C., the sublimation or the pyrolysis of the colorant in the kneaded composition may be induced by the effect of heat or the condition of hydrated condition of the colorant may be changed result in unstable color hue by the effect of heat. Further, when the aggregation condition of the colorant is not uniform, the color hue of the obtained toner may not be uniform and color contamination may occur.

In producing the electrostatic image developing toner of the present invention, a specific aminophenol compound is added as a constituting component of the toner particles. The method to add a specific aminophenol compound in the toner particles during preparation of the toner of the present invention is not specifically limited under the condition that a predetermined amount of the specific aminophenol compound is contained in the finally obtained toner particles.

Specific examples of adding a specific aminophenol compound are as follows. In a pulverization method, for example, the followings can be applied: to supply a specific aminophenol compound to a pre-mixing step in combination with other constituting components of the toner particles; to obtain a colored mixture composed of a specific aminophenol compound and a colorant and then to supply the colored mixture to a kneading step with other constituting components of the toner particles.

In a polymerization method, for example in an emulsion polymerization aggregation method, the followings can be applied: to prepare a dispersion of particles made of specific aminophenol compound, and then to mix the dispersion with a dispersion of particles composed of other constituting components of the toner particles so as to aggregate, associate and coalesce the particles; to prepare a dispersion composed of particles of a specific aminophenol compound and colored particles made of a colorant (a particle dispersion of a colorant component), then to mix the dispersion with then to mix the dispersion with a dispersion of particles composed of other constituting components of the toner so as to aggregate, associate and coalesce the particles.

Here, "an emulsion polymerization aggregation method" is a method for producing a toner containing the following steps: to prepare a dispersion composed of binder resin particles made by a emulsion polymerization method; to mix the binder resin particle dispersion with a dispersion of particles composed of other constituting components of the toner particles; to aggregate the particles at a slow rate by taking an appropriate balance between the repulsion force of particle surface by controlling the pH and the aggregation force of particles induced by addition of an aggregating agent composed of an electrolyte so as to associate the particle resulting in controlling an average diameter and a particle diameter distribution and at the same time to coalesce the particles by stirring with heating so as to control the shape of particles.

The binder resin particles may contain a layered structure composed of two or more layers each having a different binder resin. In this case, the following two step polymerization method can be applied: to prepare a dispersion of first resin particles made by a conventional emulsion polymerization method (a first polymerization step); and add a polymerization initiator and a polymerizable monomer thereto so as to polymerize the system (a second polymerization step).

An aqueous medium can be used for the preparation of the toner particle of the present invention. Here, "an aqueous medium" indicates a medium in which 50 to 100 weight % of water and 0 to 50 weight % of water soluble solvent are contained. Examples of a water soluble solvent are: methanol, ethanol, isopropanol, butanol, acetone, methyl ethyl ketone and tetrahydrofuran. Preferred solvents are alcohol type solvents which do not dissolve the obtained resin.

In producing the toner particle of the present invention which incorporates a colored composition composed of a specific aminophenol compound and a colorant, the content of the specific aminophenol compound in the colored composition is preferably from 1 to 650 ppm.

By controlling the content of the specific aminophenol compound in the colored composition to be within the above-described range, an expected amount of the specific aminophenol compound can be contained in the toner particles of the electrostatic image developing toner of the present invention.

The electrostatic image developing toner of the present invention may contain solely toner particles, but it may contain, as external additives, inorganic or organic particles having a number average primary particle diameter of 4 to 800 nm, or a lubricant along with the toner particles.

By adding an external additive in the toner, fluidity and charging property of the toner can be improved and, at the same time, cleaning property and transferring property of the toner can be also improved.

(Inorganic Particles)

As the inorganic particles, known particles may be used in the present invention. More specifically, minute particles of silica, titania, alumina, strontium titanate may preferably be used. These inorganic particles that are subjected to the hydrophobic treatment may be used according to the necessity.

Listed as the specific silica particles may be, for example, the commercially available products, R-805, R-976, R-974, R-972, R-812 and R-809 manufactured by Nippon Aerosil Co., Ltd.; HVK-2150, H-200 manufactured by Hoechst AG; TS-720, TS-530, TS-610, H-5 and MS-5 manufactured by Cabot Corp.

Listed as the titania particles may be, for example, the commercially available products manufactured, T-805, T-604 by Nippon Aerosil Co. Ltd.; MT-100S, MT-100B, MT-500BS, MT-600, MT-600SS, JA-1 manufactured by Tayca Co., Ltd.; TA-300SI, TA-500, TAF-130, TAF-510, TAF-510T manufactured by Fuji Titan Co., Ltd.; IT-S, IT-OA, IT-OB, IT-OC and the like manufactured by Idemitsu Kosan Co., Ltd.

Listed as the alumina particles may be, for example, commercially available products, RFY-C, C-604 manufactured by Nippon Aerosil Co., Ltd.; TTO-55 and the like manufactured by Ishihara Sangyo Kaisha Ltd.

(Organic Particles)

Further, as the organic particles, those having a number average primary particle diameter of about 10 through 2000 nm with a spherical shape may be used. More specifically, homopolymers such as styrene and methyl methacrylate and their copolymer may be used.

(Lubricant)

In the toner of the present invention, a lubricant may be mixed and used with the toner particles for the purpose of increasing the cleaning property and transfer property according to the necessity. Listed as the lubricant may be, for example, the metal salts of higher fatty acid such as zinc stearate, aluminum stearate, copper stearate, magnesium stearate, calcium stearate; zinc oleate, manganese oleate, iron oleate, copper oleate, magnesium oleate; zinc palmitate, copper palmitate, magnesium palmitate, calcium palmitate; zinc linoleate, calcium linoleate; zinc ricinoleate, and calcium ricinoleate.

The adding amount of these lubricants is preferably 0.1 through 10.0% by weight based on the total weight of the toner.

As the method of adding the lubricant, various types of known mixers may be used such as a turbular mixer, a HENSCHEL MIXER, a Nauter mixer, and a V-type mixer.

The toner of the present invention may be used as a mono-component magnetic developer or a mono-component non-magnetic developer. Further, the toner of the present invention may be used as a two-component developer by mixing with a carrier.

When the toner of the present invention is used as a two-component developer, a full-color image having high color reproducing property can be produced at a high production rate without failure by using an apparatus such as tandem type image forming apparatus which will be described later. Further, by appropriately selecting the constituting materials in the toner of the present invention, the toner can be suitably used for a low temperature fixing, which should have a fixing temperature of about 100° C.

When the toner of the present invention is used as a two-component developer, various types of carriers made of known materials may be used. Examples of these are magnetic particles composed of metals such as iron, ferrite, and magnetite; and an alloy made of aluminium, lead and these metals. Of these, specifically preferable is the ferrite particle. The volume median diameter ($D50_v$) of the carrier is preferably 15 to 100 μm, and more preferably 25 to 80 μm.

When the toner of the present invention is used as a one-component non-magnetic developer, charging of the toner is carried out by pressing and rubbing the toner particles composed of the toner onto a charging member or a surface of a roller. Hence, the structure of a developing member in the image forming apparatus can be simplified. Consequently, the whole of the image forming apparatus can be made compact and a full-color image having a high color reproduction property can be produced even in a working environment with a limited space.

The toner particles in the electrostatic toner of the present invention contains a compound represented by Formula (1) in a specific amount, which results in stabilization of an anion charge on the toner particles composed of the toner. As a result, high image transfer property can be provided. This leads to form an intermediate color (half-tone) image of high quality. The hydrogen bonding existing in the binder resin tends to be decreased by the presence of the specific compound. This leads to high storage stability of the toner and high fixing property of the toner.

Consequently, by employing the electrostatic charge developing toner of the present invention, superior transfer property and fixing property can be achieved with having high storage stability. As a result, an image of high quality can be formed.

The image transferring property of the electrostatic image developing toner of the present invention can be improved by containing a compound represented by Formula (1) (a specific aminophenol compound) in an amount of 0.1 to 65 ppm based on the total weight of the toner particles. As a result, a half-tone image becomes uniform and the obtained image quality is improved remarkably.

The reason for this improvement is considered as follows: the specific aminophenol compound temporarily neutralizes the charge when the electrostatic image developing toner is negatively overcharged which is considered to be one of the reasons to decrease transferring property of the image.

More specifically, the proton of the hydroxyl group in the specific aminophenol compound is supposed to transfer to the amino group. This will result in a keto form for the hydroxyl group and an ammonium form having a positive charge for the amino group by attaining equilibrium for each group. From this reason, it is preferably that the amino group and the hydroxyl group are bonded in a meta position of the phenyl ring with each other.

In practice, the amount of charge of over-charged toner can be sufficiently compensated with a presence of a specific aminophenol compound in an amount of 0.1 to 65 ppm, because the density of the functional groups contributing to triboelectric charging is very small. When the amount of the specific aminophenol compound is more than this range, generation of the inverse charged toner may be promoted.

Further, the specific aminophenol compound has a strong hydrogen bonding property because it has an amino group and a hydroxyl group both provided with a lone pair. Therefore, it may form a hydrogen bonding with a carbonyl group or a carboxyl group in a monomer relating to a binder resin (a binder resin monomer) resulting in increasing the strength of a toner image. In addition to that, the adhesion of the toner image to the transfer paper will be increased by formation of a hydrogen bonding with a hydroxyl group in cellulose contained in the transfer paper. As a result, fixing property of the image (more specifically, fixing strength of the formed image at a folding portion of the transfer paper) is assumed to be increased.

Further, the specific aminophenol compound will bind with a colorant such as a dye of a low molecular weight which is located in a binder resin via a hydrogen bonding. Therefore, by setting the content of the specific aminophenol compound within a specific range, a plasticizing effect caused by a colorant of a low molecular weight can be suppressed. This will contribute to stabilize the image during storage.

A fixing apparatus, which is employed for image formation employing the electrostatic image developing toner of the present invention, will now be, described.

FIG. 1 is a cross-sectional view showing one example of the constitution of the fixing apparatus employed for image formation employing the electrostatic image developing toner of the present invention. The above fixing apparatus 10 is constituted of heat roller 12 heated by induction heating mechanism 14, which is an external heating mechanism, fixing roller 13 which is extended parallel to the above heat roller 12 while being separated from it, fixing belt 11 composed of a looped heat resistant belt which is entrained on heat roller 12 and fixing roller 13 and which rotates clockwise via either rotation of heat roller 12 or fixing roller 13, and pressure roller 15 which is rotated by fixing roller 13 and which forms fixing nip portion N via pressure contact onto fixing roller 13 via fixing belt 11. Fixing belt 11 is heated via heat roller 12 which is initially heated via induction heating mechanism 14.

Heat roller 12 is a hollow cylinder composed of magnetic metals such as iron, cobalt, or nickel, or alloys thereof. Its external diameter is, for example, 20-40 mm and its wall thickness 0.3-1.0 mm. It is constituted so that heat capacity is low and enables a high rate of temperature rise easily.

Fixing roller 13 is composed, for example, of cored bar 13*a* made of metals such as stainless steel and elastic member 13*b* which covers cored bar 13*a* with heat resistant silicone in the form of a solid or foamed material. The external diameter of above fixing roller 13 is about 20-about 40 mm and is greater than the external diameter of pressure roller 16. Further, the wall thickness of elastic member 13*b* is to be about 4-6 mm. Further, hardness of fixing roller 13 is 10-50 degrees in terms of Asker C hardness, which is determined at a load of 9.8 N via ASKER-C Type meter, produced by Kobunshi Keiki Co., Ltd.

In the aforesaid fixing apparatus 10, fixing belt 11 is heated in contact position W with heat roller 12 which is heated via induction heating mechanism 14, and the inner surface of fixing belt 11 is continually heated via rotation of heat roller 12 and fixing roller 13, whereby entire fixing belt 11 is heated.

Fixing belt 11 is constituted, for example, in such a manner that a heating layer, an intermediate elastic layer, and a releasing layer are formed on a metal substrate in the stated order. Thickness of the releasing layer is preferably 10-300 μm, but is most preferably about 200 μm.

Further, as substrates of fixing belt 11, instead of metal substrates, employed may be heat resistant resin substrates such as fluororesins, polyimide resins, polyamide resins, PEEK resins, PES resins, PPS resins.

Pressure roller 15 is composed, for example, of cored bar 15*a* composed of a cylindrical member made of highly electrically conductive metals such as copper or aluminum, and of elastic layer 15*b* exhibiting high heat resistance and high releasing properties provided on the surface of the aforesaid cored bar 15*a*. As materials to constitute cored bar 15*a*, employed may be SUS (stainless steel).

Hardness of the aforesaid pressure roller 15 is specified to be 80-100 degrees in terms of Asker C hardness, while its external diameter is specified to be 20-40 mm, and the wall thickness of the elastic layer is specified to be 0.5-2.0 mm.

Induction heating mechanism 14 refers to one in which heat roller 12 is heated via an electromagnetic induction system, and which includes exciting coil 16, which is a magnetic field generating means, and coil guide plate 17 wound on above exciting coil 16. Coil guide plate 17 is in a semi-cylindrical shape in which coil guide plate 17 is arranged near the peripheral surface of heat roller 12, and exciting coil 16 is formed in such a manner that a long exciting coil wire is alternatively wound along above coil guide plate in the axial direction of heat roller 12. In addition, the oscillation circuit of exciting coil 16 is connected to a variable frequency drive source (not shown).

On the external side of exciting coil 16, semi-cylindrical exciting coil core 18 composed of ferromagnetic materials of a relative magnetic permeability of 2,500 such as ferrites, is fixed in core supporting member 18A and is arranged near exciting coil 16.

In the above fixing apparatus 10, a high frequency alternative current of 10 kHz-1 MHz, but preferably of 20-800 kHz, is applied to exciting coil 16 from the drive power source to generate an alternating: magnetic field, whereby at the contact site of heat roller 12 with fixing belt 11 and the adjacent site, the resulting magnetic field affects heat roller 12 and the heat generating layer of fixing belt 11, and an eddy current formed in the direction which hinders the change of the alternating magnetic fields in these interiors generates Joule heat corresponding to the resistance of the heat generating layer and heat roller 12 and fixing belt 11 in the above contact site W and adjacent site thereof are subjected to electromagnetic induction heating. Temperature of the inner surface of looped fixing belt 11, heated as above, is detected via temperature detection means 19 composed of a highly temperature sensitive element such as a thermistor arranged near the inlet side of fixing nip section N in contact with the interior surface of fixing belt 11. Further, fixing is carried out within fixing nip section N via heat from heated fixing belt 11.

One example of fixing conditions via the fixing apparatus shown in FIG. 1 includes a fixing temperature (surface temperature of fixing belt 11 in fixing nip section N) of 70-210° C., and a nip width of fixing nip section N of 5-40 mm, but preferably 11-30 mm. Fixing nip section N, as described herein, refers to the contact width of toner image T formed on image support P with the surface of fixing belt 11. Further, contact load between fixing roller 13 and pressure roller 15 is specified to be 40-350 N, but preferably to 50-300 N.

Further, in the image forming method according to the present invention, it is possible to form images in the range of a moving rate (hereinafter also referred to as a "printing rate") of the image support in the fixing nip section of 230-500 mm/second.

Figure 2:
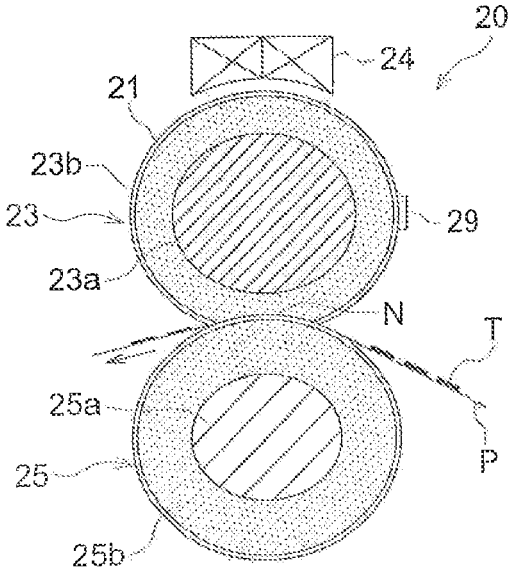
FIG. 2 is a cross-sectional view showing another example of the constitution of a fixing apparatus employed for image formation employing the electrostatic image developing toner of the present invention.

FIG. 2 is a cross-sectional view showing another example of the constitution of a fixing apparatus employed in image formation employing the electrostatic image developing toner of the present invention.

The aforesaid fixing apparatus 20 is provided with a fixing pressure roller which is formed in such a manner that elastic layer 23*b*, composed of elastic foam materials, is formed on the exterior peripheral surface of cored bar 23*a* while fixing belt 21 is wound, induction heating mechanism 24 which is arranged while facing fixing pressure roller 23 via the aforesaid fixing belt 21, and pressure roller 25 which is pressed onto fixing pressure roller 23 via the aforesaid fixing belt 21.

Fixing belt 21 is formed in such a manner that a releasing layer, of a thickness of at least 10 μm, is formed on a heat generating material layer, of a thickness of at most 40 μm, while the heat capacity of the aforesaid fixing belt 21 is specified to be 0.017-0.077 J/k/cm$^2$.

Further, the aforesaid fixing belt 21 is guided via guide members, not shown, arranged at both ends in the axial direction (perpendicular to the page surface in FIG. 2) so that the cylindrical shape is nearly maintained during rotation of fixing pressure roller 23.

Pressure roller 25 incorporates cored bar 25*a* having thereon hard foam layer 25*b*, and the hardness of the aforesaid pressure roller 25 is specified to be greater than that of fixing pressure roller 23. Further, the outer diameter of pressure roller 25 is specified to be nearly equal to that of fixing pressure roller 23.

In FIG. 2, 29 is a temperature detection sensor Composed of, for example, a thermistor and the like, which are arranged in contact with or near the outer peripheral surface of fixing belt 21, and the output of induction heating mechanism 24 is controlled based on the temperature detected by the aforesaid temperature detection sensor 29.

In fixing apparatus 20, constituted as above, by rotating pressure roller 25, for example, counterclockwise via a drive mechanism, not shown, fixing belt 21 is driven for clockwise rotation. In such a manner, image support P, on which toner image T is formed, passes through fixing nip section N, whereby toner images are fixed on image support P via heat and pressure. Further, fixing pressure roller 23 is rotated along with rotation of fixing belt 21.

The aforesaid fixing apparatus 20 enables fixing in conditions similar to fixing apparatus 10 shown in FIG. 1.

Figure 3:
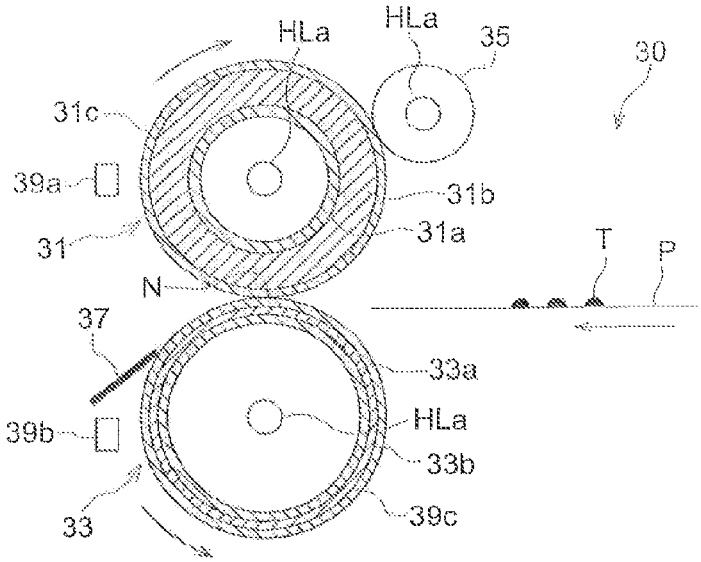
FIG. 3 is a cross-sectional view showing yet another example of the constitution of a fixing apparatus employed for image formation employing the electrostatic image developing toner of the present invention.

FIG. 3 is a cross-sectional view showing yet another example of the constitution of the fixing apparatus employed for image formation, employing the electrostatic image developing toner of the present invention.

The aforesaid fixing apparatus 30 is provided with: fixing roller 31 which is arranged to be brought into contact with one surface (in FIG. 3, for example, the upper surface of image support P) on which non-fixed toner images on image support P have been formed, pressure roller 33 which is arranged to be brought into pressure contact with it, external heating rotation body 35 which is arranged to be brought into contact with the surface of fixing roller 31, and forced peeling means 37, which is arranged so that its front edge is brought into contact with pressure roller 33, and fixing nip section N is formed via a pressure contact section of the aforesaid fixing roller 31 with pressure roller 33. In FIG. 3, 39*a* and 39*b* each is anon-contact type temperature sensing means.

Fixing roller 31 houses heating source HLa composed of heater lamps such as a halogen lamp, and is a soft roller composed of cylindrical cored bar 31*a* housing the aforesaid heating source HLa in its interior, heat resistant elastic layer 31*b*, and covering layer 31*c* formed on the surface of the aforesaid heat resistant elastic layer 31*b* through an adhesion layer (not shown) which is prepared by coating and sintering latex, such as a mixture of fluorocarbon rubber and fluororesins.

Further, heating source HLa is arranged within cored bar 31*a* so that it is stretched in the length direction of fixing roller 31, and for example, a lighting state is subjected to on-off control via a control means, not shown, based on the surface temperature of fixing roller 31 detected by temperature detection means 39*a*, so that the outer peripheral temperature of fixing roller 31, which is a directly heated member, is maintained within the predetermined temperature range.

Examples of heat resistant elastic materials, which constitute heat resistant elastic layer 31*b*, include silicone rubber, foamed silicone rubber, and fluorocarbon rubber, but it is specifically preferable to employ the silicone rubber. The thickness of the aforesaid heat resistant elastic layer 31*b* is preferably in the range of 1.0-4.0 mm. When the thickness of heat resistant elastic layer 31*b* is at most 0.2 mm, a concern is that it is not possible to form visible images of high quality since difficulty results in such a manner that the surface of fixing roller 31 is not easily compatible with the roughness of the surface of image support P which carries toner images. Further, when the thickness of heat resistant elastic layer 31 is less than 1.0 mm, fixing roller 31 results in convex against pressure roller 33, whereby it becomes difficult to assure the width of fixing nip section N.

On the other hand, when the thickness of heat resistant layer 31*b* is excessive, a concern may be that during heating the surface of fixing roller 31 via heating source HLa arranged within cored bar 31*a*, it is not possible to assure sufficient heat response.

Materials which constitute cored bar 31*a* are not particularly limited, but listed may be metals such as aluminum, iron, or copper, and alloys thereof.

Covering layer 31*c* functions as a toner releasing layer to avoid toner adhesion, and is composed of fluororesin-containing releasing resins selected from the group consisting of polytetrafluoroethylene (PTFE), copolymers of tetrafluoroethylene with perfluoroalkoxyethylene (PFA), and copolymers of tetrafluoroethylene with hexafluoropropylene (FEP), and its thickness is preferably at most 50 μm.

By preparing covering layer 31*c* employing fluororesins, surface releasing properties of fixing roller 31 to the toner itself are enhanced via its releasing action, whereby without applying releasing oil such as silicone oil to fixing roller 31, adhesive materials derived from the toner rarely adhere to the surface of fixing roller 31, and simultaneously, releasing properties of image support P from fixing roller 31 are enhanced.

By regulating the thickness of covering layer 31*c* to be at most 50 μm, the surface of fixing roller 31 is easily compatible with the roughness of the surface of image support P on which non-fixed toner images are formed on fixing roller 31, whereby it is possible to retard image deterioration.

In addition, in order to easily form uniform covering layer 31*c*, it is more preferable to regulate its thickness to at least 20 μm.

It is possible to form the aforesaid covering layer 31*c*; specifically, for example, (1) via formation of a layer of a thickness of 20-50 μm by coating releasing resins in a dispersed state, followed by sintering, and (2) via formation in which a releasing resin tube, formed at a thickness of 20-50 μm is covered, followed by adhesion.

Hardness of fixing roller 31 is 60-85 degrees in terms of Asker C hardness, determined at a load of 9.8N, via ASKER C meter, produced by Kobunshi Keiki Co., Ltd.

As pressure roller 33, as shown in FIG. 3, it is possible to employ a soft roller which is composed, for example, of cylindrical cored bar 33*a*, heat resistant elastic layer 33*b* formed on the outer periphery of the aforesaid cored bar 33*a*, and covering layer 33*c* formed on the surface of the aforesaid heat resistant elastic layer 33*b*.

In the example of the above drawing, pressure roller 33 houses heating source HLa in the same manner as fixing roller 31. The aforesaid heating source HLa is arranged while stretched in the length direction of pressure roller 33 in the interior of cored bar 33*a*. Based on the surface temperature of pressure roller 33, which is detected via temperature detection means 39*b*, for example, a lighting state is subjected to on-off control so that the temperature of the outer peripheral surface which is a direct heating object is maintained within the specified temperature range, via control means not shown.

Examples of heat resistant elastic materials, which constitute heat resistant elastic layer 33*b*, include silicone rubber, foamed silicone rubber, and fluorocarbon rubber, and it is specifically preferable to employ the silicone rubber. Thickness of the aforesaid heat resistant elastic layer 33*b*, if heat resistant elastic layers 31*b* and 33*b* exhibit nearly the same hardness, is specified to be less than the thickness of heat resistant elastic layer 31*b* of fixing roller 31, and is commonly 0.5-3 mm.

By regulating the thickness of heat resistant elastic layer 33*b* of pressure roller 33 to be less than that of heat resistant elastic layer 31*b* of fixing roller 31, it is possible to achieve a shape in which in fixing nip section N, pressure roller 33 of one fixing rotation body is convex against fixing roller 31 of the other fixing rotation body.

Materials constituting cored bar 33*a* are not particularly limited, and include metals such as aluminum, iron, or copper, and alloys thereof.

Specific examples of materials constituting covering layer 33*c* include resins, composed of fluororesins as a major component, such as polytetrafluoroethylene (PTFE), copolymer (PFA) of tetrafluoroethylene and perfluoroalkoxyethylene, or a copolymer (FEP) of tetrafluoroethylene and hexafluoropropylene.

It is possible to form covering layer 33*c*; specifically, for example, (1) via formation of a layer of a thickness of 20-50 μm by coating fluororesins in a dispersed state followed by sintering, and (2) via formation in which cored bar 33*a* is covered with a 20-50 μm thick fluororesin tube.

It is preferable that pressure roller 33 exhibits greater hardness than that of fixing roller 31, and for example, a hardness of 65-90 degrees in terms of Asker C hardness.

It is possible to employ, as external heating rotation body 35, one composed, for example, of a cylindrical cored bar housing heating source HLa composed of halogen heater lamps and a covering layer formed on the outer peripheral surface of the aforesaid cored bar.

It is possible to employ, as compulsory releasing means 37, one which is composed of a plate member incorporating a thin 0.2 mm thick stainless steel plate, having thereon a releasing layer which is formed via lamination of a thin film composed of fluororesins such as polytetrafluoroethylene (PTFE), and in which the thickness of the front edge is 0.2 mm and the straightness (being deviation of the plate member from linearity) is at most 0.5 mm.

The above fixing apparatus 30 enables fixing under the same conditions as for fixing apparatus 10, shown in FIG. 1.

Figure 4:
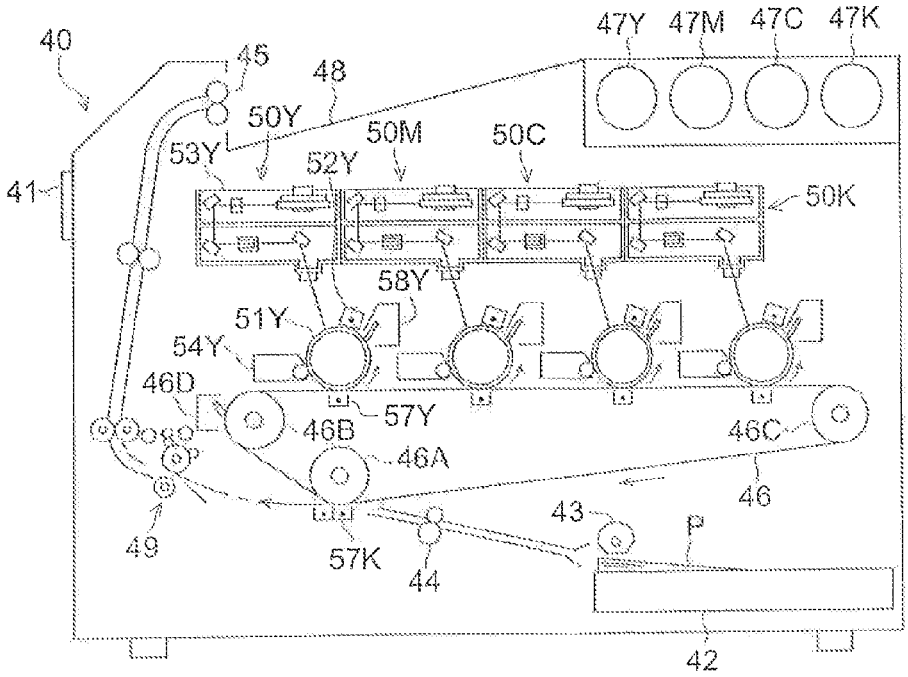
FIG. 4 is a schematic view showing one example of the constitution of the image forming apparatus employed for image formation employing the electrostatic image developing toner of the present invention.

FIG. 4 is a schematic view showing one example of the constitution of an image forming apparatus employed for image formation employing the electrostatic developing toner of the present invention.

Above image forming apparatus 40 is a tandem color image forming apparatus, and is provided with a plurality of image forming units 50Y, 50M, 50C, and 50K arranged along belt shaped intermediate transfer body 46, paper feeding cassette 42 and fixing apparatus 49. In FIG. 4, 41 is an operation section, while 47Y, 47M, 47C, and 47K each is a toner cartridge of each respective color.

Image forming unit 50Y forms yellow toner images and is provided with photoreceptor 51Y. About above photoreceptor 51Y arranged are charging means 52Y, exposure means 53Y, developing unit 54Y, primary transfer means 57Y, and cleaning means 58Y.

Image forming units 50M, 50C, and 50K respectively form magenta, cyan and black toner images, instead of forming yellow images and each is constituted similarly to image forming unit 50Y.

Yellow toner images are formed via image forming unit 50Y, magenta toner images are formed via image forming unit 50M, cyan toner images are formed via image forming unit 50C, while black toner images are formed via image forming unit 50*k*.

Intermediate transfer body 46 is entrained about a plurality of holing rollers 46A, 46B, and 46C and is movably maintained in circulation. Above intermediate transfer body 46 is arranged with cleaning apparatus 46D.

In the above image forming apparatus, a toner image of each color formed via image forming units 50Y, 50M, 50C, and 50K is sequentially subjected to primary transfer onto intermediate transfer body 46 during rotation via primary transfer means 57Y, 57M, 57C, and 57K, whereby a superimposed color toner image is formed.

Meanwhile, image supports P, housed in paper feeding cassette 42 are fed one by one via paper feeding roller 43 and each is conveyed to secondary transfer means 57A via resist roller 44, whereby the color toner image is subjected to secondary transfer onto the aforesaid image support P.

Subsequently, image support P is conveyed to fixing apparatus 49, followed by fixing, and thereafter, is sandwiched between paper ejection rollers 45 to be ejected onto paper ejection tray 48, in the outside of the apparatus.

It is possible to list, as an image support, various types such as plain paper, from thin to thick, quality paper, coated printing paper such as art paper or coated paper, commercial Japanese paper and postcard paper, and PET (polyethylene terephthalate) for OHP, but image supports are not limited thereto.

EXAMPLES

Specific examples of the present invention will now be described, however, the present invention is not limited thereto.

Production Example 1 of Electrostatic Image Developing Toner: Toner Production Via Pulverization Method (1) Preparation Example of Binder resin (Styrene Acrylic Resin)

In xylene, dissolved and mixed were 50 parts by weight of Component A of a maximum molecular weight of 3,600 and a glass transition point of 62° C., composed of 100 parts by weight of styrene, 20 parts by weight of Component B of a maximum molecular weight of 100,000 and a glass transition point of 62° C., composed of 73 parts by weight of styrene, 25 parts by weight of n-butyl acrylate, and 2 parts by weight of acrylic acid, and 25 parts by weight of Component C of a maximum molecular weight of 600,000 and a glass transition point 60° C., composed of 80 parts by weight of styrene and 20 parts by weight of n-butyl acrylate. The resulting resin solution was dried under reduced pressure, whereby a styrene acrylic resin (hereinafter also referred to as "Styrene Acrylic Resin (1)") was prepared.

(2) Addition Example of Specific Aminophenol Compound)

Exemplified Compound (A-1) (being a magenta colorant) as a colorant and Exemplified Compound (22) as a specific aminophenol compound were mixed via a Henschel mixer, produced by Mitsui Mining Co., Ltd., whereby a colorant composition (hereinafter also referred to as "Colorant Composition (1)") was prepared which was composed of the magenta colorant incorporating 270 ppm of the specific aminophenol compound.

(3) Preparation Example of Toner

After mixing 10,000 parts by weight of Styrene Acrylic Resin (1), 750 parts by weight of Colorant Composition (1) composed via incorporation of Exemplified Compound (22) (being the specific aminophenol compound) at a ratio of 2.7 parts by weight, and 400 parts by weight of natural gas based Fischer Tropsch wax (at a melting point 100° C.) as a releasing agent were mixed via a Henschel mixer (produced by Mitsui Mining Co., Ltd.) over 20 minutes, the resulting mixture was kneaded at a specified heating temperature of 115° C., employing a biaxial extrusion kneader. Thereafter, pulverization was carried out via a jet system pulverizer, followed by classification via a pneumatic classifier, whereby toner particles of a volume based median diameter of 9.5 μm and an average circularity of 0.948 were prepared.

By mixing 100 parts by weight of the resulting toner and 0.6 part by weight of hydrophobic silica "R-805" (produced by Aroesil Co. Ltd.) via a Henschel mixer (produced by Mitsui Mining Co., Ltd.), an electrostatic image developing toner (hereinafter also referred to as "Toner (1)") was prepared.

Meanwhile, the shape and particle diameter of the resulting toner particles were not changed via the addition of external additives.

Production Example 2 of Electrostatic Image Developing Toner: Toner Production via Pulverization Method (1) Preparation Example of Binder Resin (Polyester Resin)

Into a four-necked 2 L glass flask fitted with a thermometer, a stainless steel stirring rod, a nitrogen introducing glass pipe, and a flow-down system condenser, placed were 132 g of neopentyl glycol, 60 g of ethylene glycol, 279 g of terephthalic acid, and 1.5 g of dibutyl tin laurate, and while stirring, the resulting mixture underwent reaction for 5 hours under conditions of nitrogen ambience, normal pressure, and 170° C. in a mantle heater. When the softening point value determined by ASTM E28-51T resulted in no change, addition was made into 108 g of 1,2,4-benzenetricarboxylic anhydride, and the reaction was further continued under the condition of a temperature of 210° C. The reaction progress was traced via the softening point determined by ASTM E28-51T, and when the softening point reached the predetermined temperature, the reaction was terminated followed by cooling to room temperature, whereby a polyester resin (hereinafter also referred to as "Polyester Resin (1)") was prepared.

(2) Addition Example of Specific Aminophenol Compound)

By mixing Exemplified Compound (A-2) (being a magenta colorant) as a colorant and Exemplified Compound (38) as a specific aminophenol compound employing a BAIBURO mill (produced by Uras-Techno Co., Ltd.), a colorant composition (hereinafter also referred to as "Colorant Composition (2)") was prepared which incorporated 650 ppm of the specific aminophenol compound.

(3) Preparation Example of Toner

After mixing 10,000 parts by weight of Polyester Resin (1), 750 parts by weight of Colorant Composition (2) composed via incorporation of Exemplified Compound (38) (being the specific aminophenol compound) at a ratio of 6.5 parts by weight, and 200 parts by weight of wax (at a melting point 84° C.) in which the major components were fatty acid esters (being fatty acid esters mainly composed of alcohol having 32 carbon atoms and fatty acids having 24 carbon atoms) as a releasing agent were mixed via a Henschel mixer (produced by Mitsui Mining Co., Ltd.) over 20 minutes, the resulting mixture was kneaded at a specified heating temperature of 115° C., employing a biaxial extrusion kneader. Thereafter, pulverization was carried out via a jet system pulverizer, followed by classification via a pneumatic classifier, whereby toner particles of a volume based median diameter of 7.8 μm and an average circularity of 0.926 were prepared.

By mixing 100 parts by weight of the resulting toner and 0.6 part by weight of hydrophobic silica "R-805" (Produced by Aroesil Co., Ltd.) via a Henschel mixer (produced by Mitsui Mining Co., Ltd.), an electrostatic image developing toner (hereinafter also referred to as "Toner (2)") was prepared.

Meanwhile, the shape and particle diameter of the resulting toner particles were not changed via the addition of external additives.

Production Example 3 of Electrostatic Image Developing Toner: Toner Production via Emulsion Polymerization Coalescence Method (1) Preparation Example 1 of Colorant Composition Particle Dispersion An aqueous surface active agent solution was prepared by dissolving, while stirring, 7.0 parts by weight of "DOWFAX 2A-1" (produced by Dow Chemical Co.) as a surface active agent in 160 parts by weight of ion-exchanged water. Into the resulting aqueous surface active agent solution, gradually added were 20 parts by weight of colorant "C.I. Solvent Yellow 162" and 0.03 part by weight of Exemplified Compound (13) as a specific aminophenol compound, followed by carrying out dispersion employing a "SC mill" (produced by Mitsui Mining Co., Ltd.), whereby a colorant composition particle dispersion (hereinafter referred to as "Colorant Composition Particle Dispersion (1)") was prepared in which the specific aminophenol compound was incorporated at a ratio of 160 ppm and minute colorant particles and minute specific aminophenol compound particles were dispersed.

The diameter of the minute colorant particles in resulting Colorant Composition Dispersion (1) was determined in terms of volume based median diameter, resulting in 200 nm.

The volume based median diameter was determined via "MICROTRAC UPA-150" (produced by Honeywell Co.) under determination conditions of a sample refractive index of 1.59, a sample specific gravity of 1.05 (in terms of spherical particles), a solvent refractive index of 1.33, and a solvent, viscosity of 0.797 (at 30° C.) and 1.002 (at 20° C.), while 0 point adjustment was carried out by pouring ion-exchanged water into the measurement cell.

(2) Preparation Example 1 of Toner Particles (A) Preparation of Resin Particles for Core Portion (a) First Stage Polymerization In a reaction vessel fitted with a stirring unit, a temperature sensor, a cooling pipe, and a nitrogen introducing unit, placed was an aqueous surface active agent solution prepared by dissolving 4 parts by weight of an anionic surface active agent composed of sodium dodecyl sulfate ($C_{10}H_{21}(OCH_2CH_2)_2SO_3Na$) in 3,040 parts by weight of ion-exchanged water, and a polymerization initiator solution which was prepared by dissolving 10 parts by weight of potassium persulfate (KPS) in 400 parts by weight of ion-exchanged water was added. After increasing the temperature of the resulting solution to 75° C., a polymerizable monomer solution composed of 532 parts by weight of styrene, 200 parts by weight of n-butyl acrylate, 8 parts by weight of methacrylic acid, and 16.4 parts by weight of n-octylmercaptan was dripped over one hour. Thereafter, polymerization (being first stage polymerization) was carried out by heating the resulting mixture at 75° C. for 2 hours while stirred, whereby a resin particle dispersion (1H) incorporating resin particles (1h) was prepared.

The weight average molecular weight of the resulting resin particles (1h) was 165,000.

(b) Second Stage Polymerization

Into a flask fitted with a stirring unit, placed was a polymerizable monomer solution composed of 101.1 parts by weight of styrene, 62.2 parts by weight of n-butyl acrylate, 12.3 parts by weight of methacrylic acid, and 1.75 parts by weight of n-octylmercaptan. Thereafter, 93.8 parts by weight of paraffin wax "HNP-57" (produced by Nippon Seiro Co., Ltd.) were added, followed by dissolution by increasing the interior temperature to 90° C., whereby a monomer solution was prepared.

On the other hand, an aqueous surface active agent solution, which was prepared by dissolving 3 parts by weight of the anionic surface active agent employed in the first stage polymerization in 156 parts by weight of ion-exchanged water was placed, and heating was carried out so that the interior temperature reached 98° C. To the above aqueous surface active agent solution, 32.8 parts by weight of resin particles (1h) prepared by the first stage polymerization were added and a monomer solution incorporating paraffin wax was further added. Thereafter, the resulting mixture was subjected to mixing dispersion over 8 hours employing "CLEARMIX" (produced by M Technique Co.), whereby a emulsified particle dispersion incorporating emulsified particles (oil droplets) of a dispersion particle diameter of 340 nm was prepared.

Subsequently, added to the above dispersion was a polymerization initiator solution prepared by dissolving 6 parts by weight of potassium persulfate in 200 pars by weight of ion-exchanged water and polymerization (second stage polymerization) was carried out by heating, while stirring, the above system over 12 hours at 98° C., whereby a resin particle dispersion (1HM) incorporating resin particles (1hm) was prepared.

The weight average molecular weight of the resulting resin particles (1hm) was 2,000.

(c) Third Stage Polymerization

Into resin particle dispersion (1HM) prepared in the second stage polymerization, added was a polymerization initiator solution prepared by dissolving 5.45 parts by weight of potassium persulfate in 220 parts by weight of ion-exchanged water, and under a temperature condition of 80° C., a polymerizable monomer solution composed of 293.8 parts by weight of styrene, 154.1 parts by weight of n-butyl acrylate, and 7.08 parts by weight of n-octylmercaptan was dripped over one hour. After dripping, polymerization (being third stage polymerization) was carried out by heating for 2 hours while stirring. Thereafter, the temperature was lowered to 28° C., whereby a resin particle dispersion incorporating Resin Particles (1) for the core portion was prepared.

The weight average molecular weight of the resulting Resin Particles (1) for the core portion was 26,800.

(B) Preparation of Resin Particles for Shell

Resin Particles (1) for the shell were prepared in the same manner as the first stage polymerization except that as polymerizable monomers, 624 parts by weight of styrene, 120 parts by weight of hexyl acrylate, 56 parts by weight of methacrylic acid, and 16.4 parts by weight of n-octylmercaptan were employed.

(c) Preparation of Toner Particles (a) Formation of Core Portion

In a reaction vessel fitted with a stirring unit, a temperature sensor, a cooling pipe, and a nitrogen introducing unit, placed were 420.7 parts (in terms of solids) by weight of Resin Particles (1) for the core portion, 900 parts by weight of ion-exchanged water, and 200 parts by weight of Colorant Composition Dispersion (1), and while stirring the resulting mixture, the interior temperature was regulated to 30° C. Thereafter, the pH was regulated to 8-11 via the addition of a 5 mol/liter aqueous sodium hydroxide solution.

Subsequently, an aqueous solution, prepared by dissolving 2 parts by weight of magnesium chloride tetrahydrate in 1,000 parts by weight of ion-exchanged water, was added while stirring at 30° C. over 10 minutes. After the resulting mixture was allowed to stand for 3 minutes, the temperature of the resulting system was increased to 65° C. over 60 minutes. Under the above state, the average diameter of coalesced particles was determined via "COULTER MULTISIZER III (produced by Coulter Co.), and when the volume based median diameter reached 5.9 μm, particle growth was terminated via the addition of an aqueous solution prepared by dissolving 40.2 parts by weight of sodium chloride in 1,000 parts by weight of ion-exchanged water. Further, fusion was continuously carried out via heating while stirring over one hour at a liquid temperature of 70° C., whereby a core portion containing liquid which incorporated Core Portion (1) was prepared.

The average circularity of resulting Core Portion (1) was determined via "FPIA2100" (produced by Sysmex Co.), resulting in 0.970.

(b) Shell Formation

After regulating Core Portion Containing Liquid (1) to 65° C., 96 parts by weight of Resin Particles (1) for the shell were added, and further, an aqueous solution, prepared by dissolving 2 parts by weight of magnesium chloride hexahydrate in 1,000 parts by weight of ion-exchanged water, was added over 10 minutes. By heating the resulting mixture to 70° C. while stirring the same over one hour, Resin Particles (1) for the shell were fused onto the surface of Core Portion (1). Thereafter, ripening was carried out at a liquid temperature of 75° C. over 20 hours to form the shells.

Thereafter, the ripening (being the shell formation) was terminated via the addition of an aqueous solution prepared by dissolving 40.2 parts by weight of sodium chloride in 1,000 parts by weight of ion-exchanged water. Subsequently, cooling was carried out under a condition of 8° C./minute, and formed particles were collected via filtration, followed by several washings with ion-exchanged water at 45° C., and drying via air flow heated at 40° C., whereby toner particles constituted, in such a manner that a shell is formed on the surface of the core portion, were prepared.

The volume based median diameter of the resulting toner particles was determined, resulting in 6.6 nm. Further, the average circularity was determined via "FPIA2100", produced by Sysmex Co., resulting in 0.970.

(3) External Addition

To the resulting toner particles, added were external additives composed of 0.6 part by weight of hexamethylsilazane treated silica (at an average diameter of the primary particles of 12 nm), and 0.8 part by weight of n-octylsilane treated titanium dioxide (at an average diameter of the primary particles of 24 nm), and external addition was carried out by mixing the above under conditions of a stirring blade peripheral rate of 35 m/second, a treating temperature of 35° C., and a treatment duration of 15 minutes, employing a Henschel mixer (produced by Mitsui Mining Co. Ltd.), whereby an electrostatic image developing toner (hereinafter referred to as "Toner (3)" was prepared.

It is to be noted that the shape and particle diameter of toner particles in Toner (3) were not changed via the addition of external additives.

Production Examples 4, 5, and 9-20 of Electrostatic Image Developing Toner: Toner Production Via Emulsion Polymerization Coalescence Method In Production Example 3 of the electrostatic image developing toner, by employing the colorant and specific aminophenol compound listed in the following Table 1, a colorant composition particle dispersion, incorporating the aforesaid aminophenol compound at the ratio listed in Table 1, was prepared via the same method as in Preparation Example of the colorant composition particle dispersion, and toner particles were prepared in the same manner as Preparation Example 1 of toner particles, except that the above resulting colorant composition particle dispersion was employed. Further, by applying the external addition to the resulting toner particles, electrostatic image developing toners (hereinafter referred to as "Toners (4), (5), and (9)-(20))", respectively) were prepared.

Production Example 6 of Electrostatic Image Developing Toner: Toner Production via Emulsion Polymerization Coalescence Method In Production Example 3 of the electrostatic image developing toner, by employing a colorant composition composed of 61 ppm of Exemplified Compound (38) as a specific aminophenol compound together with Exemplified Compound (A-2) (being a magenta colorant) as a colorant, a colorant composition particle dispersion, incorporating the aforesaid specific aminophenol compound, was prepared via the same method as in Preparation Example of the colorant composition particle dispersion, and toner particles were prepared in the same manner as Preparation Example 1 of toner particles, except that the above resulting colorant composition particle dispersion was employed. Further, by applying the external addition to the resulting toner particles, an electrostatic image developing toner (hereinafter referred to as "Toner (6)") was prepared.

Production Examples 7 and 8 of Electrostatic Image Developing Toners: Toner Production via Emulsion Polymerization Coalescence Method Toner particles were prepared in the same manner as the aforesaid Production Example 6 of the electrostatic image developing toner, except that in Production Example 6 of the electrostatic image developing toner, the colorant composition having the composition listed in Table 1 was employed. Further, by applying the external addition to the resulting toner particles, electrostatic image developing toners (hereinafter referred to as "Toner (7) or (8)") were prepared.

Production Examples 1-3 of Comparative Electrostatic Image Developing Toners Comparative toner particles were prepared in the same manner as Preparation Example 1 of toner particles, except that in Production Example 3 of the electrostatic image developing toner, the colorant listed in Table 1 was employed, while no specific aminophenol compound was employed. Further, by applying the external addition to the resulting toner particles, comparative electrostatic image developing toners (hereinafter referred to as "Comparative Toners (1)-(3)", respectively) were prepared.

Production Examples 4-7 of Comparative Electrostatic Image Developing Toner

In Production Example 3 of the electrostatic image developing toner, a colorant composition particle dispersion incorporating the aforesaid specific aminophenol compound at the ratio listed in Table 1 was prepared via the same method as in Preparation Example 1 of the colorant composition particle dispersion, and toner particles were prepared in the same manner as Preparation Example 1 of toner particles, except that the above resulting colorant composition particle dispersion was employed. Further, prepared were electrostatic image developing toners (hereinafter, referred to as "Comparative Toners (4)-(7)") by applying external addition to the resulting toner particles.

(Determination of Content of Specified Aminophenol Compound in Toner)

The content of the specific aminophenol compound in each of resulting Toners (1)-(14) and Comparative Toners (1)-(7) was determined via conventional liquid chromatography/mass spectrometry (LC/MS). Table 1 shows the results.

Determination of the content of specific aminophenol compounds was carried out as follows. One g of a toner was dissolved in 20 mL of THF (tetrahydrofuran), and the resulting solution was diluted with methanol by a volume factor of 100, and resin components were removed via a membrane filter of a sieve mesh of 0.2 μm. A sample isolated via liquid chromatography was employed for determination.

TABLE 1

| | Colored Composition | | | Electrostatic Image Developing Toner | | |
|---|---|---|---|---|---|---|
| | | Specific Aminophenol Compound | | Content of Specific Aminophenol | Particle | |
| | Type of Colorant | Compound No. | Added Amount (ppm) | Compound (ppm) | Diameter D50v (μm) | Average Circularity |
| Toner 1 | **A-1 | 22 | 270 | 23 | 9.5 | 0.918 |
| Toner 2 | **A-2 | 38 | 650 | 45 | 7.8 | 0.926 |
| Toner 3 | S.Y.162 | 13 | 160 | 55 | 6.6 | 0.970 |
| Toner 4 | **B-1 | 59 | 180 | 62 | 5.2 | 0.975 |
| Toner 5 | S.B.67 | 18 | 175 | 60 | 6.9 | 0.972 |
| Toner 6 | **A-2 | 38 | 61 | 21 | 5.0 | 0.973 |
| Toner 7 | **A-2 | 38 | 131 | 45 | 6.4 | 0.969 |
| Toner 8 | **A-2 | 38 | 84 | 29 | 6.7 | 0.968 |
| Toner 9 | **B-2 | 74 | 143 | 49 | 7.1 | 0.955 |
| Toner 10 | **B-3 | 68 | 175 | 60 | 6.0 | 0.961 |
| Toner 11 | S.Y.162 | 3 | 160 | 55 | 6.8 | 0.970 |
| Toner 12 | **A-3 | 41 | 175 | 60 | 6.3 | 0.962 |
| Toner 13 | S.B.67 | 18 | 173 | 51 | 6.2 | 0.960 |
| Toner 14 | Aniline Black | 8 | 142 | 49 | 6.7 | 0.978 |
| Toner 15 | **A-2 | 38 | 5 | 0.4 | 6.4 | 0.967 |

TABLE 1-continued

| | Colored Composition | | | Electrostatic Image Developing Toner | | |
|---|---|---|---|---|---|---|
| | | Specific Aminophenol Compound | | Content of Specific Aminophenol | Particle | |
| | Type of Colorant | Compound No. | Added Amount (ppm) | Compound (ppm) | Diameter D50v (μm) | Average Circularity |
| Toner 16 | **A-2 | 38 | 166 | 14 | 6.6 | 0.959 |
| Toner 17 | **A-2 | 38 | 2 | 0.1 | 6.6 | 0.961 |
| Toner 18 | **A-2 | 38 | 4 | 0.3 | 6.5 | 0.957 |
| Toner 19 | **A-1 | 13 | 6 | 0.4 | 6.6 | 0.956 |
| Toner 20 | **A-1 | 13 | 166 | 14 | 6.5 | 0.959 |
| *1 | S.Y.162 | — | — | 0 | 5.9 | 0.970 |
| *2 | S.B.67 | — | — | 0 | 6.2 | 0.977 |
| *3 | Aniline Black | — | — | 0 | 5.3 | 0.962 |
| *4 | S.Y.162 | 75 | 198 | 68 | 6.8 | 0.971 |
| *5 | **A-3 | 52 | 204 | 70 | 6.7 | 0.968 |
| *6 | S.B.67 | 43 | 198 | 68 | 6.4 | 0.975 |
| *7 | Aniline Black | 38 | 207 | 71 | 6.5 | 0.972 |

*Comparative Toner,
**Exemplified Compound

In Table 1, "P.Y.162" represents "C.I. Pigment Yellow 162", while "S.B.67" represents "C.I. Solvent Blue 67".

Developer Production Examples 1-20 and Production Examples of Comparative Developers 1-7

A ferrite carrier of a volume average particle diameter of 60 coated with silicone resins, was mixed with each of Toners (1)-(20) and Comparative Toners (1)-(7) so that concentration of the aforesaid electrostatic image developing toner reached 8% by weight, whereby Developers (1)-(20), and Comparative Developers (1)-(7) were prepared.

Examples 1-20 and Comparative Examples 1-7

Each of the developers was evaluated as follows. Table 2 shows the results.

(1) Evaluation of Transferability

By employing an electrophotographic system color electrophotographic image forming apparatus, "bizhub C500", produced by Konica Minolta Business Technologies, Inc.), 10,000 sheets of a monochromatic character image of a pixel ratio of 11% (being a solid image at a pixel density of 1.3 and a size of 20 mm×50 mm) were prepared in an ambience of a temperature of 32° C. and a relative humidity of 85%. Subsequently, based on the consumed toner weight (specifically, the fed toner weight from the toner feeding reservoir in the development unit) and the weight of the residual toner after transfer (specifically, the toner amount recovered by the cleaning means), a transfer ratio was calculated via the following Equation (3).

Transferability was evaluated based on the following criteria:

A (good): the transfer ratio was at least 98%

B (no practical problem): the transfer ratio was between at least 96% and less than 98%

C (poor): the transfer ratio was less than 96%

$$\text{Transfer ratio (\%)} = ((\text{consumed toner weight} - \text{residual toner weight after transfer})/(\text{consumed toner weight}))\times 100 \quad \text{Equation (3)}$$

(2) Image Quality Evaluation of Intermediate Tone Image

By employing an electrophotographic system color electrophotographic image forming apparatus, "bizhub C500" (produced by Konica Minolta Business Technologies, Inc.), images of a low pixel ratio of 30% were formed under an ambience of a temperature of 32° C. and a relative humidity of 85%. Thereafter, intermediate tone images were formed, and existence or non-existence of dust on the resulting images was confirmed via a 20-power magnifying glass and simultaneously, visual evaluation was made whether image quality resulted in no grainy feel or not.

Existence or non-existence of dust was evaluated as follows:

A: no toner particles were observed between dots constituting the image

B: 1-3 toner particles irregularly existed between dots

C: many toner particles were scattered between dots

No grainy feel of images was evaluated via the following criteria:

A: no graininess was felt

B: slight graininess was felt via attentive observation

C: roughness or graininess was felt

Further, based on evaluation of existence or non-existence of dust and of existence or non-existence of no grainy feel, the lower rank evaluation was employed as the overall evaluation.

(3) Evaluation of Storage Stability

In a 10 mL glass bottle of an inner diameter of 1 mm, placed was 0.5 g of a toner constituting a developer, and the bottle was lidded. After shaking the above bottle 600 times at room temperature employing "TAPDENSER KYT-2000" (produced by Seishin Enterprise Co., Ltd.), the lid was removed and the resulting bottle was allowed to stand for 48 hours in an ambience of a temperature 55° C. and a relative humidity of 35%. Subsequently, the toner in the bottle was carefully placed on a 100-mesh cylinder so that the resulting aggregates were not crushed. The ornament was set and fixed in POWDER TESTER (produced by Hosokawa Micron Corp.) via a hold-down bar and a knob nut, and vibrated for 10 seconds under the condition so that the vibration strength resulted in a conveying width of 1 mm. The weight (specifically, the ratio (% by weight)) of the residual compounds with respect to 0.5 g of the toner employed for evaluation of residual compounds (being granular compounds) on the cylinder was evaluated based on the following criteria:

A: no residual granular compounds were noted, whereby neither a cold insulator nor chilled transportation was required B: residual granular compounds were less than 1% by weight, whereby no practical problem resulted during image formation C: residual granular compounds were at least 1% by weight, whereby practical problems occurred in such a manner that image defects were frequently formed which included image staining and white spots (minimum density) due to spilling of granular compounds composed of the toner from the development apparatus.

(4) Evaluation of Fixability

"Fold-fixing ratio" was determined which referred to the ratio of toner peeling generated in the fold portion, when a toner fixed material is folded, and fixability (fixing strength) was evaluated based on the above fold-fixing ratio.

In practice, by employing an electrophotographic system color electrophotographic image forming apparatus, "bizhub C500 (produced by Konica Minolta Business Technologies), a solid image at an image density of 0.8 was produced in an ambience of a temperature of 20° C. and a relative humidity of 59%. The resulting image was folded into two. After rubbing three times the fold line via three fingers, the resulting image was unfolded, and the image forming surface was wiped with "JK WIPER" (produced by Crecia Co., Ltd.). The image density was then determined, and the fold-fixing ratio was calculated via the determined value using the following Equation (4). Subsequently, evaluation was made based on the fold fixing ratio as follows.

A: the fold-fixing ratio was at least 90%

B: the fold-fixing ratio was at least 80%—less than 90%

C: the fold-fixing ratio was less than 80%

Fold-fixing ratio (%)=((image density after folding)/(image density prior to folding))×100 Equation (4)

What is claimed is:

1. A method for producing a toner for an electrostatic charge image developer comprising the steps of:

forming a color composition comprising a colorant and a compound represented by Formula (1) in an amount of 1 to 650 ppm based on the total weight of the color composition;

mixing the color composition with a binder resin to form toner particles;

forming a toner from the toner particles; and controlling the weight ratio of the color composition to binder in the mixing step such that the toner contains 0.1 to 65 ppm of the compound represented by Formula (1) based on the total weight of the toner, Formula (1)

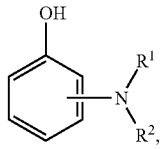

wherein $R^1$ and $R^2$ each respectively represents a hydrogen atom, an alkyl group having 1 to 4 carbon atoms, or an aryl group.

2. The toner for an electrostatic charge image development of claim 1, wherein the compound represented by Formula (1) is an ortho substituted compound represented by Formula (1A) or a meta substituted compound represented by Formula (1B):

TABLE 2

| | | Transferability | | Image Quality Evaluation of Intermediate Tone Image | | | Storage Stability | | Fixability | |
|---|---|---|---|---|---|---|---|---|---|---|
| | | Transfer Ratio (%) | *1 | Existence of Dust | Image Quality | Overall Evaluation | Residue Weight (%) | *1 | Fold-Fixing Ratio (%) | *1 |
| Example 1 | ** 1 | 97 | B | A | B | B | 0.08 | B | 85 | B |
| Example 2 | ** 2 | 99 | A | A | B | B | 0.06 | B | 84 | B |
| Example 3 | ** 3 | 99 | A | A | A | A | * 2 | A | 93 | A |
| Example 4 | ** 4 | 97 | B | B | B | B | * 2 | A | 90 | A |
| Example 5 | ** 5 | 99 | A | A | A | A | * 2 | A | 91 | A |
| Example 6 | ** 6 | 97 | B | A | A | A | * 2 | A | 95 | A |
| Example 7 | ** 7 | 97 | B | A | B | B | * 2 | A | 90 | A |
| Example 8 | ** 8 | 96 | B | A | B | B | 0.02 | B | 88 | B |
| Example 9 | ** 9 | 96 | B | B | B | B | 0.04 | B | 89 | B |
| Example 10 | ** 10 | 97 | B | B | A | B | * 2 | A | 91 | A |
| Example 11 | ** 11 | 99 | A | A | A | A | * 2 | A | 95 | A |
| Example 12 | ** 12 | 96 | B | B | B | B | 0.05 | B | 85 | B |
| Example 13 | ** 13 | 99 | A | A | A | A | * 2 | A | 95 | A |
| Example 14 | ** 14 | 99 | A | A | A | A | * 2 | A | 92 | A |
| Example 15 | ** 15 | 99 | A | A | A | A | * 2 | A | 97 | A |
| Example 16 | ** 16 | 99 | A | A | A | A | * 2 | A | 96 | A |
| Example 17 | ** 17 | 98 | A | A | A | A | * 2 | A | 91 | A |
| Example 18 | ** 18 | 98 | A | A | A | A | * 2 | A | 93 | A |
| Example 19 | ** 19 | 98 | A | A | A | A | * 2 | A | 95 | A |
| Example 20 | ** 20 | 98 | A | A | A | A | * 2 | A | 95 | A |
| Comp. 1 | *** 1 | 91 | C | C | B | C | 1.80 | C | 71 | C |
| Comp. 2 | *** 2 | 90 | C | C | C | C | 2.50 | C | 70 | C |
| Comp. 3 | *** 3 | 88 | C | C | C | C | 2.00 | C | 74 | C |
| Comp. 4 | *** 4 | 95 | C | B | C | C | 3.20 | C | 80 | C |
| Comp. 5 | *** 5 | 89 | C | C | C | C | 3.50 | C | 82 | B |
| Comp. 6 | *** 6 | 96 | B | B | B | B | 2.90 | C | 70 | C |
| Comp. 7 | *** 7 | 91 | C | C | C | C | 2.60 | C | 78 | C |

Comp.: Comparative Example,

** Developer,

*** Comparative Developer,

*1: Evaluation,

*2: not detected

Formula (1A)

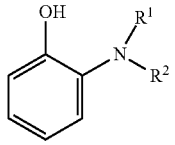

Formula (1B)

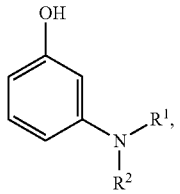

wherein $R^1$ and $R^2$ each represents the same as described in Formula (1).

3. The toner for an electrostatic charge image development of claim 2, wherein the compound represented by Formula (1) is a meta substituted compound represented by Formula (1B):

Formula (1B)

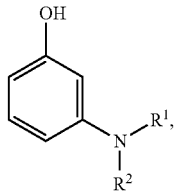

wherein $R^1$ and $R^2$ each represents an alkyl group having 1 to 4 carbon atoms.

4. The toner for an electrostatic charge image development of claim 1, wherein the colorant is a dye.

* * * * *